11/86 4,569,891

United States Patent [19]

Shimizu et al.

[11] Patent Number: 4,569,891

[45] Date of Patent: Feb. 11, 1986

[54] PHOTOCONDUCTIVE MATERIAL

[75] Inventors: Isamu Shimizu, Yokohama; Minori Yamaguchi, Akashi, both of Japan

[73] Assignee: Kanegafuchi Chemical Industry Co., Ltd., Osaka, Japan

[21] Appl. No.: 595,366

[22] Filed: Mar. 30, 1984

[30] Foreign Application Priority Data

Mar. 31, 1983 [JP] Japan ..... 58-57447

[51] Int. Cl.[4] ..... G03G 5/08; G03G 5/082; G03G 5/14

[52] U.S. Cl. ..... 430/57; 430/60; 430/63; 430/65; 430/66; 430/67; 252/501.1; 313/386; 313/530; 313/541; 313/542

[58] Field of Search ..... 430/57, 60, 63, 65, 430/66, 67; 252/501.1; 313/386, 530, 541, 542

[56] References Cited

U.S. PATENT DOCUMENTS 3,006,786 10/1961 Sjoberg ..... 313/542 X
3,508,918 4/1970 Levy ..... 430/65

FOREIGN PATENT DOCUMENTS 1804014 4/1970 Fed. Rep. of Germany ..... 430/57
1035892 7/1966 United Kingdom ..... 430/63
320802 12/1971 U.S.S.R. ..... 430/57

OTHER PUBLICATIONS

Chem. and Engr. News, Dec. 3, 1984, pp. 33-34.

*Primary Examiner*—Roland E. Martin
*Attorney, Agent, or Firm*—Wegner & Bretschneider

[57] ABSTRACT

A multi-layered photoconductive material which comprises first layers containing at least one VIb chalcogen element chosen from S, Se and Te and second layers containing at least one IIb element chosen from Zn, Cd and Hg and acting as electric potential barriers, said first layers and said second layers being alternatively arranged and the total number of said first layers and said second layers being not less than 5 and has a high response speed and an excellent sensitivity to long wavelength light with a great dark resistance.

7 Claims, 4 Drawing Figures

PHOTOCONDUCTIVE MATERIAL

BACKGROUND OF THE INVENTION

This invention relates to a photoconductive material. More particularly, it relates to a photoconductive material which exhibits a high response speed and can be easily controlled in sensitivity not only to long wavelength light but also to short wavelength light.

As the photoconductive material which absorbs the energy of the electromagnetic radiation such as ultraviolet rays, visible rays, infrared rays and X-rays to produce carriers for electric charge and increase the electroconductivity, there are known inorganic photoconductive materials such as Se, CdS, ZnO and $As_2S_3$ as well as organic photoconductive materials such as poly-N-vinylcarbazole, trinitrofluorenone, phthalocyanine compounds and triphenyl-amine-polycarbonate. While these conventional inorganic or organic photoconductive materials are utilized in various fields depending upon their photoconductive characteristics, they have more or less some certain drawbacks; hence it is always necessary for their practical use to make some adjustments for overcoming those drawbacks. Thus, they are not satisfactory for overall purposes.

In general, organic photoconductive materials can be readily molded in a sheet or film form and easily controlled in sensitivity to the wavelength of light. Since, however, the mobility of the carrier for electric charge is small, their application in the field requiring a high speed response is restricted. On the other hand, inorganic photoconductive materials can show a high mobility of the carrier for electric charge. But, the control of their sensitivity to the wavelength of light is difficult. Even if successful in controlling the sensitivity, other characteristic properties such as the mobility of the carrier, the lifetime of the carrier and the proportion of the photoconductivity to the dark conductivity are lowered. In order to overcome the above drawbacks inherent to organic or inorganic photoconductive materials, attempts have been made to design photoconductive materials of separation-of-function type which are constituted with organic photoconductive materials and inorganic photoconductive materials in combination. However, no satisfactory one has been obtained yet.

With respect to photosensitivity, response speed, durability, stability in molding technique, etc., a-Se (the prefix "a-" meaning "amorphous"), Cd-S, Cd-Se, a-Se-As-Te, etc. are favorable photoconductive materials. In particular, a-Se has been practically utilized as the photoconductive material for copying machines over a long period of time. This a-Se material has a large dark resistance (i.e. $10^{13}$ to $10^{15}$ ohm.cm), and when irradiated with light, the resistivity is greatly decreased. With a-Se, a photoconductive film of stabilized quality can be readily prepared by vacuum evaporation. The trap level present in the bulk of a-Se is low, and the mobility of the hole as the major carrier is about 0.2 $cm^2/V.sec.$ so that it can correspond to a high speed response. As well known, however, a-Se has a highly sensitive area near the wavelength of 470 nm and shows little sensitivity to the wavelength of 600 nm or more. This is because the generation step of the photo carrier is controlled by the geminate recombination so that the generation efficiency ($\eta$) of the photo carrier rapidly decreases against light having a long wavelength; the application field of a-Se is thus restricted. Also, a-Se crystallizes when irradiated with strong light or heated, and its photoconductive characteristics are markedly deteriorated. For prevention of these defects, attempts have been made to incorporate As, Te, etc. therein. However, the photoconductive material of Se containing Te and As (i.e. a-Se-As-Te) produces the increase of light fatigue as well as the deterioration of response characteristics.

Compound semi-conductors such as CdS and CdSe have a high photosensitivity and are excellent in heat stability. However, the preparation of uniform films with them is difficult, and their molding can be made only by disadvantageous procedures comprising sintering of fine particles or mixing with resinous binders.

Accordingly, the appearance of a photoconductive material which can be readily prepared in the form of thin film, has a great dark resistance, exerts good photoconductive characteristics on light irradiation and is excellent in sensitivity to long wavelength light has been highly demanded. Such photoconductive material would be widely applicable to various fields and can be utilized, for instance, in such laser printers, line sensors, etc. as using semi-conductor laser, which require a high speed response. Since, however, the conductivity ($\sigma d$) at dark is elevated with the increase of the energy gap (Eg) between the valency electron zone and the conductor, it will be hardly possible to achieve the increase of the sensitivity to long wavelength light and the decrease of the dark current simultaneously. This invention is directed to the solution of this inconsistent technical problem.

SUMMARY OF THE INVENTION

According to this invention, each of layers comprising a VIa chalcogen element and each of layers comprising a IIb element are alternatively plated by vacuum evaporation to make an integral multi-layered structure having ultra-lattice properties, whereby the increase of the sensitivity to long wavelength light and the decrease of the dark conductivity are simultaneously attained.

Thus, the multi-layered photoconductive material of this invention comprises first layers containing at least one VIa chalcogen element chosen from sulfur (S), selenium (Se) and tellurium (Te) and second layers containing at least one IIb element chosen from zinc (Zn), cadmium (Cd) and mercury (Hg) and acting as electric potential barriers, said first layers and said second layers being alternatively arranged and the total number of said first layers and said second layers being not less than 5.

In the above structure, the conjunction of the VIa chalcogen element and the IIb element produces an n-type semi-conductor such as ZnS, ZnSe, CdS, CdSe or CdTe. The hetero-junction of said n-type semi-conductor and the VIa chalcogen element can provide their interface with a rectification function. When a number of such hetero-junctions are piled up by vacuum evaporation plating to make a thin film, electric potential barriers corresponding to the number of interfaces are produced in the thin film. There can be thus obtained an electric photoconductive material which has a small dark conductivity ($\sigma d$) and wherein an electric current flows over said potentials upon irradiation with light.

DETAILED DESCRIPTION OF THE INVENTION

Figure 1:
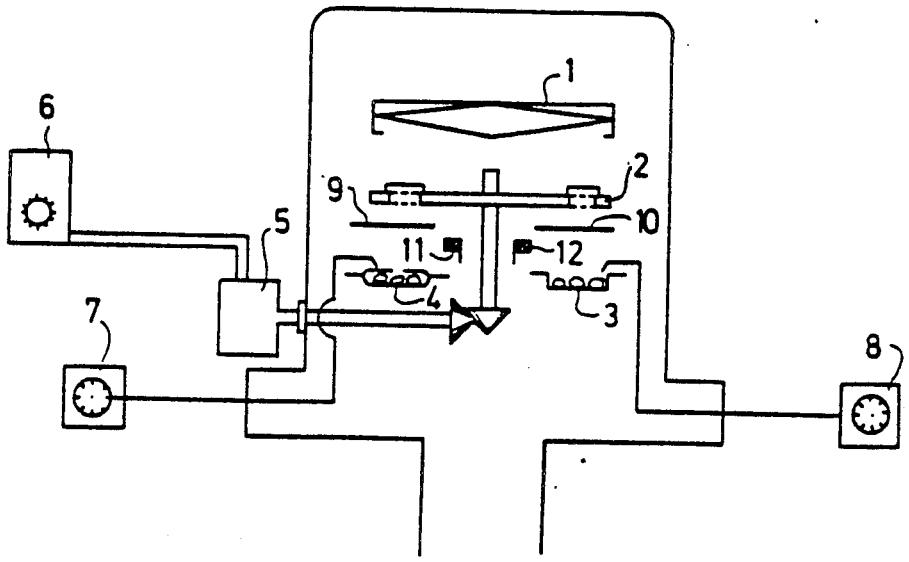
FIG. 1 is a schematic representation of a vacuum evaporator useful in preparing the photoconductors of the present invention.

The multi-layered structure of the photoconductive material according to this invention comprises multiple layer units as piled up, each layer unit having a thickness of 2 to 1000 Å, preferably of 10 to 500 Å. The term "layer unit" is intended to mean the combination of a first layer and a second layer as piled up, the first and second layers being as defined above, which has an interface available as a potential barrier. Taking the case using Se and Cd as an example, Se layers (each layer having a thickness of 10 Å) and Cd layers (each layer having a thickness of 5 Å) are alternatively piled up to make a multi-layered film in which the bonding of Cd-Se is produced at the interface between Se and Cd by the mutual diffusion and reaction on or after the piling up so that Se/Cd (Se) layers (each layer having a thickness of about 15 Å) having a concentration gradient are formed. A multiplicity of such Se/Cd (Se) layers are piled up to constitute a photoconductive film, and each (Se/Cd) layer having about 15 Å is the layer unit. This consideration may be likewise applied to the case wherein three or more elements are used for defining the layer unit. When, however, the thickness of the layer unit is small, both the mutual diffusion of the elements and the reaction between the elements take place, and therefore it is hardly possible to clearly define the interface. Anyhow, the introduction of the potential barrier as produced near the interface into a photoconductive material makes it possible to form a ultra-lattice like structure in case of the thickness of the layer unit being small so that the running inhibition of the light producing carrier is suppressed.

The first layer comprises not less than 50 atomic % of at least one chalcogen element chosen from S, Se and Te. If necessary, any other element, for instance, chosen from Groups VI and II may be additionally included therein. The second layer comprises at least one of Zn, Cd and Hg, usually in an amount of 0.1 to 90% by weight and is capable of forming an electric potential barrier against the first layer. In addition to Zn, Cd and/or Hg, it may comprise usually any VIa element. When desired, however, any other element may be contained therein. Thus, specific examples of the elements which may be optionally included in addition to said essential elements in the first or second layer are As, Ge, Ga, Si, Sb, etc. The thickness of the first layer as well as that of the second layer may be optionally selected within a range of several to several thousands Å. Further, each of the first or second layers may be divided into two or more layers (i.e. sub-layers). When, for instance, the first layer is divided into two sub-layers, i.e. 1-*a* and 1-*b*, and a difference in fermi level is present between those sub-layers, potential barriers are formed between the sub-layers 1-*a* and 1-*b* and also between those and the second layer. Thus, this case is substantially equal to the layer unit consisting of three layers, i.e. the sub-layer 1-*a*, the sub-layer 1-*b* and the second layer. It is not necessary to use the same composition throughout all the first or second layers. The total number of the first layers and the second layers is required to be five or more so as to provide a potential fluctuation. From the practical viewpoint, it is desirable that each layer has a thickness of not more than 0.1 $\mu$m and the od value after multi-layered is not more than $1\times10^{-12}$ ohm$^{-1}$.cm$^{-1}$.

The multi-layering may be carried out by a per se conventional procedure such as vacuum evaporation, sputtering, CVD process or MBE process. Among them, particularly preferred is vacuum evaporation, because the operation is simple and the quality of the product is excellent.

When the multi-layering is effected by vacuum evaporation plating, there may be used a multi-source evaporation apparatus, which is a vacuum evaporation apparatus having multiple evaporation sources. In the multi-source evaporation apparatus, a substrate plate is exposed to the vapors of various elements or compounds supplied from the evaporation sources. For application of the vapors to a substrate plate in order, such substrate plate may be moved forward and backward in a piston mode so as to pass through above each evaporation source. Also, the evaporation sources may be moved so as to apply the vapors from them onto the substrate plate in order. Further, for instance, the substrate plate under the rotation may be contacted with the vapors from the evaporation sources. Furthermore, for instance, the vapors may be applied to the substrate plate with the control of the temperatures of the evaporation sources or of the opening and closing of the shutters.

A typical example of the manufacture of a multi-layered film comprising IIb elements and VIa chalcogen elements by the use of a multi-source evaporation apparatus is set forth below:

As the multi-source evaporation apparatus, there is used the type "EVB-6CH" manufactured by Nippon Shinku Gijutsu-sha. Elements are supplied in the form of simple substance or compound to the evaporation sources, and the substrate plate under rotation is contacted with the vapors from the evaporation sources in order. The rotation speed is variable within a range of 0 to 150 rpm. Inside of each belljar, there is provided an evaporation source, which is separated with an aluminum made separator so as to prevent the mixing of the vapor therefrom with the one from any other evaporation source. The evaporation source is subjected to board heating with a molybdenum heating board. On each board, a detecting device (quartz oscillation type) is placed for monitoring the evaporation rate from the evaporation source during the evaporation. The evaporation room is evacuated by the aid of a rotary pump and an oil diffusion pump to make a pressure of $2\text{-}3\times10^{-6}$ Torr. The control of the temperature of the substrate plate is effected automatically by sending an electric current to a tungsten heater arranged above the turn table, said electric current corresponding to the signal of a PID temperature controller. For the temperature detection, a CA thermostat is used. As the substrate plates for vacuum evaporation plating, an Oxford glass plate (23 mm$\times$16 mm$\times$0.9 mm) and a glass plate for one inch vidicon target are employed. The substrate plates are subjected to ultrasonic washing with a cleaning agent and distilled water. When the under-electrode is needed, aluminum, nickel-chromium, gold or the like is plated by vacuum evaporation while resistance-heating under a reduced pressure around $6\times10^{-6}$ Torr. When a transparent electrode is needed, indium tin oxide (ITO) is plated by vacuum evaporation while heating with electron beam to deposit on the substrate plate. The thickness of the electrode is from 100 to 500 Å. When a semi-transparent electrode is needed, there is used the one prepared by vacuum evaporation plating of aluminum or gold to make a thin film and having a transmission of 20 to 50%. The substrate plate with an aluminum under-electrode is retained in air over a period of 24 hours or more and then used for evaporation plating. The simple substance of each element and the compound comprising at least two kinds of elements as used in the examples as hereinafter given were respectively 99.9999% and 99.999%.

The photoconductive material of the invention can be readily prepared in the form of thin film, and a thin film of good performances is obtainable for a variety of substrate plates. Further, it is excellent in sensitivity to long wavelength light, and its dark resistance is very large. Furthermore, it has a high stability to heat. In addition, it shows good light response characteristics. Accordingly, the photoconductive material can be used in photosensors, line printers, etc. which require a high speed response.

The present invention will be hereinafter explained further in detail by the following Examples.

EXAMPLE 1

A glass plate for one inch vidicon target which was plated with aluminum as a under-electrode by vacuum evaporation and an Oxford glass plate (Corning 7059) without under-electrode were held on a rotating substrate plate holder of a vacuum evaporator ("EBV-6CH" manufactured by Nippon Shinku Gijutsu-sha).

The schematic view of the vacuum evaporator is shown in FIG. 1 of the accompanying drawings. As evaporating sources, Se (purity, 99.9999% supplied by Furuuchi Chemical) and Cd (purity, 99.9999% supplied by Furuuchi Chemical) were charged in heating containers 3 and 4 respectively, and the containers were separated by an aluminum made separator. Above the evaporating sources Cd and Se, shutters 9 and 10 were provided respectively to prevent the accumulation of the initially evaporated portions on the substrate plates when heated. After evacuation of the chamber to 2 to $3\times10^{-6}$ Torr, film thickness monitors 11 and 12, heating boards 3 and 4 and a heater for the substrate plates 1 were powered. When the temperature of the substrate plates reached 50° C. and the generation of the vapors from the evaporating sources Se and Cd was observed, the rotation of rotating board 2 was started. With the rotation of the rotating board, the substrate plates held on the rotating board 2 passed over the evaporating sources Cd and Se alternativly. The rate of the rotating board 2 was adjusted to 60 rpm, and the shutters 9 and 10 above the evaporating sources Cd and Se were opened to start the plating of them on the substrate plates. The evaporation rate was controlled by adjusting the power supplied to the heating boards 3 and 4 with checking the monitors 11 and 12 eqipped over the evaporating sources respectively. Still, 5 is a motor, 6 is a rotation speed controller and 7 and 8 are temperature controllers. The thickness of the thus prepared a-Se/Cd(Se) thin film was 3.7 μm, and the thickness of each unit layer (Se/Cd(Se)) was 24 Å.

Figure 2:
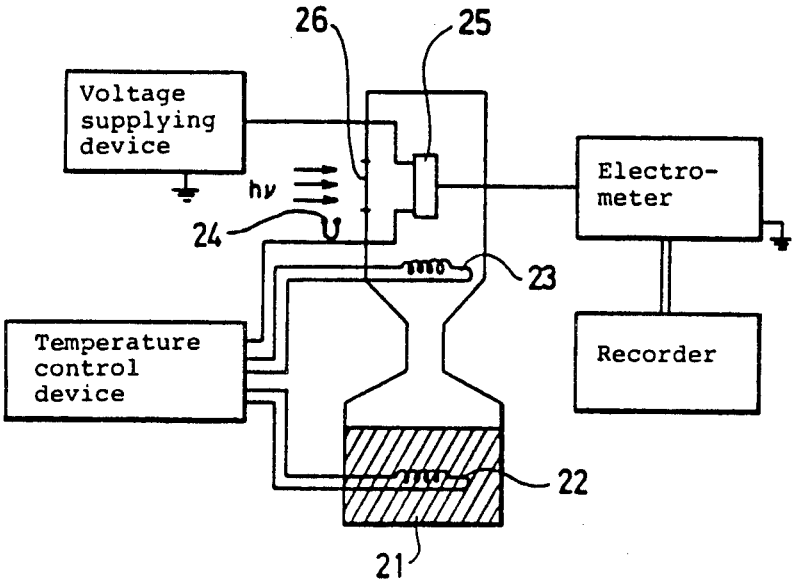
FIGS. 2 and 3 are schematic representations of a steady state current measuring device and a photo-induced-discharge tester respectively, used in testing the properties of the photoconductors.

On the surface of the a-Se/Cd(Se) thin film formed on the Oxford glass plate, aluminum was plated by vacuum evaporation under $6\times10^{-6}$ Torr to make a Gap electrode (comb pattern). The thus produced thin film was tested for current-temperature characteristics and photoelectric current by means of a steady-state current measuring device, The schematic view of the steady-state current measuring device is shown in FIG. 2 wherein 21 is liquid nitrogen, 22 and 23 are heaters, 24 is a thermostat, 25 is the sample and 26 is a window. When band conduction is induced in a semiconductor by a thermally activated carrier, its conductivity is expressed by the following equation: $\sigma=\sigma_d \exp(-E_a/kT)$ wherein $E_a$ is the activation energy of the carrier. In this measurement, $E_a$ was 0.85 eV. The conditions of the steady-state current measurement were as follows:

Distance of Gap electrodes: 200 μm
Applied voltage: 200 volts
Temperature: 40° to −10° C.

The photoconductivity at room temperature was such that the resistance was reduced by about two orders with light having a photo intensity of $1\times10^{13}$ photons/cm$^2$.sec and a wavelength of 500 nm.

Figure 3:
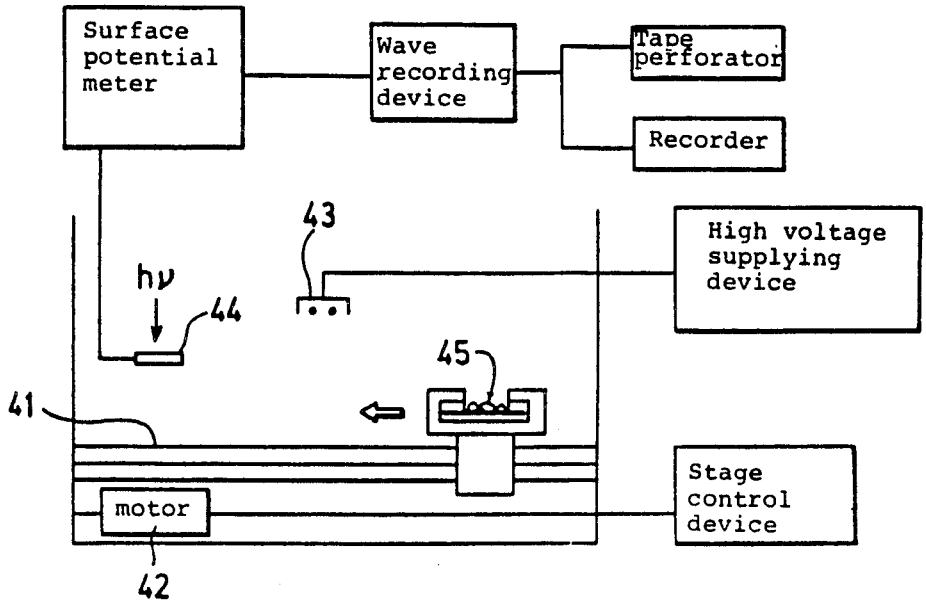
Figure 4:
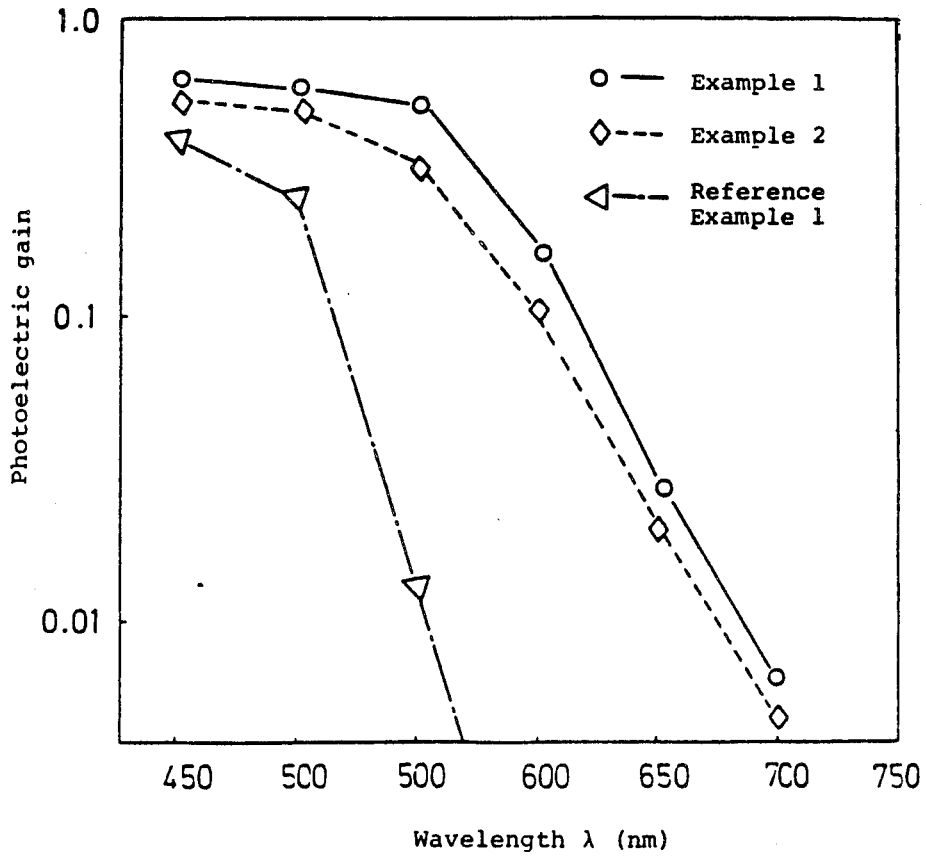
FIG. 4 is a plot of photoelectric gain versus wavelength for Examples 1 and 2 of the present invention and Reference Example 1 below.

The photoelectric characteristics of a sample was tested by means of a photo-induced-discharge tester, a schematic view of which is shown in FIG. 3 wherein 41 is a rack, 42 is a motor, 43 is a corona charger, 44 is a probe and 45 is the sample. The sample was the a-Se/Cd (Se) multi-layered film formed onto the one inch vidicon target with under-electrode. The under-electrode of the sample was earthed, and the surface of the sample was corona charged by means of a corona charger. The dark conductivity and the photoconductivity were measured. The charged electricity was about $3.8\times10^{-7}$ coulomb/cm$^2$, and the surface potential was 217 volts with the thickness of the sample being 3.7 μm. From the reducing rate of the surface potential at dark, the dark conductivity was calculated to be $\sigma d=3.9\times10^{-14}$ ohm$^{-1}$.cm$^{-1}$, which may be evaluated as excellent. For determination of the dependency of the photoconductivity on the wavelength, light having a wavelength of 450 to 750 nm was irradiated after the corona charging to measure the decay rate of the surface potential. The sample showed a good sensitivity to light having a wavelength of 450 to 650 nm. The wavelength sensitivity (photoconductive gain) at a wavelength of 450 to 750 nm is shown in FIG. 4, from which it is understood that the sample is a photoconductive material of good performances, i.e. showing a photoconductive gain of 0.5 to 1.0 to light having a wavelength of 450 to 550 nm.

REFERENCE EXAMPLE 1

In the same manner as in Example 1 but removing the Cd source, i.e. using the Se source alone, a photoconductive material was prepared. The thickness of the thin film thus produced was 4.9 μm. The dark conductivity and the photoconductive characterictics of this sample were measured as in Example 1. The activation energy $E_a$ obtained by the steady-state current measurement was 1.0 eV (distance of Gap electrodes: 200 μm; applied voltage: 200 volts; temperature: 40° to −10° C.). As to the photoconductivity at room temperature, resistance was reduced by three orders with light having a photo intensity of $1\times10^{13}$ photons/cm$^2$.sec and a wavelength of 500 nm. In the corona charge-photo decay test, the charged electricity was about $3\times10^{-7}$ coulomb/cm$^2$, and the surface potential for the film thickness of 4.9 μm was about 200 volts. The dark conductivity calculated from the decay rate of the surface potential was $\sigma d=1\times10^{-14}$ ohm$^{-1}$.cm$^{-1}$ As in Example 1, the wavelength dependency of the photoconductivity was measured. The sample showed a good photoconductivity to light having a wavelength of 450 to 550 nm but poor to light having a wavelength of 600 nm or more. The wavelength sensitivity (photoconductive gain) is shown in FIG. 4, from which it may be understood that the sensitivity to long wavelength light of the sample is very low as compared with that of the sample obtained in Example 1.

EXAMPLE 2

In the same manner as in Example 1 but reducing the deposition rate from 24 Å/sec. to 18 Å/sec. and making the thickness of the unit layer 18 Å, a multi-layered thin film having a thickness of 4.0 μm was prepared. As in Example 1, the dark conductivity and the photoconductive characterictics of the sample were measured. The activation energy $E_a$ of the carrier was 0.97 eV (distance of Gap electrodes: 200 μm; applied voltage: 200 volts; temperature: 40° to −10° C.). As to the photoconductivity at room temperature, resistance was reduced by two orders with light having a photo intensity of $1\times10^{13}$ photons/cm$^2$.sec and a wavelength of 500 nm. In the corona charge-photo decay test, the charged electricity was about $3.2\times10^{-7}$ coulomb/cm$^2$, and the surface potential for the film thickness of 4.0 μm was about 200 volts. The dark conductivity calculated from the decay rate of the surface potential was $4\times10^{-14}$ ohm$^{-1}$.cm$^{-1}$.

As in Example 1, the wavelength dependency of the photoconductivity was measured. The sample showed a good photoconductivity to light having a wavelength of 450 to 650 nm. The wavelength sensitivity (photoconductive gain) is shown in FIG. 4. In comparison with the sample of Example 1, the sample of this Example shows a greater activation energy of the carrier as large as that of the a-Se film of Reference Example 1. Yet, the sample of this Example is much improved in long wavelength sensitivity, compared with the sample of Reference Example 1. It can be thus recognized that the multi-layered film according to this invention has excellent performance properties.

EXAMPLE 3

In the same manner as in Example 1 but using Te in addition to Cd and Se as the evaporating sources, a glass plate for one inch vidicon target (plated with aluminum by vacuum evaporation) and an Oxford glass plate (without under-electrode) were held on a rotating substrate plate holder of a vacuum evaporator. Power was applied to the heating board without opening the shutters. After the stabilized generation of the vapor of Se, Cd and Te was observed, the rotation of the rotating board was started, and then the shutters were opened. The rate of rotation was 60 rpm. As the heating board for Cd and Te, there was used a closed type board for sublimating materials. The accumulation rate was about 20 Å/sec. to form a film having a thickness of 5.0 μm. Measurement as in Example 1 revealed that the activation energy $E_a$ of the carrier is 0.7 eV (distance of Gap electrodes: 200 μm; applied voltage: 200 volts; temperature: 40°to −10° C.). As to the photoconductivity at room temperature, resistance was reduced by two orders with light having a photo intensity of $1\times10^{13}$ photons/cm$^2$ and a wavelength of 500 nm. The amount of surface charge was about $3\times10^{-7}$ coulomb/cm$^2$, and the surface potential for the film thickness of 5.0 μm was about 230 volts. The dark conductivity calculated from the decay rate of the surface potential was $5\times10^{-14}$ ohm$^{-1}$.cm$^{-1}$.

The wavelength dependency of the photoconductivity of the ternary system multi-layered film was determined as in Example 1. As the result, said film was confirmed to have a sensitivity to light having a wavelength of 750 to 800 nm. Thus, it is a photoconductive material excellent in long wavelength sensitivity.

EXAMPLE 4

In the same manner as in Example 3 but using sulfur (S) in place of Se and vaporing the elements at a rate of 25 Å/sec, a S-Cd-Te multi-layered film having a thickness of 6.5 μm was prepared. As in Example 1, the activation energy of the carrier and the photoconductive characterictics of the sample were measured. The activation energy $E_a$ of the carrier was 0.77 eV. The film had a good sensitivity to light having a wavelength of 650 to 750 nm. Thus, it is a photoconductive material excellent in long wavelength sensitivity.

REFERENCE EXAMPLE 2

Using the same apparatus as in Example 1 but removing the separating board between the evaporating sources of Cd and Se and fixing the rotating substrate plate holder at approximately the same distance from said evaporating sources, co-plating of Cd and Se was carried out by vacuum evaporation.

After evacuating the evaporating chamber to $3\times10^{-6}$ Torr, the heater for the substrate plate and the heating boards for the evaporating sources were powered. When the vapors of Se and Cd were started to generate constantly, the shutters over Se and Cd were opened so as to initiate the co-plating. At the evaporation rate of about 50 Å/sec, a film having a thickness of 6.0 μm was prepared.

The photoconductive characteristics of the thus obtained film was measured according to photo-induced discharge measurement. The decay rate of the surface potential was so fast that the sample discharged during travelling from the corona charging apparatus to the probe for measuring the surface potential. From this result, it is understood that any film having photoconductive characteristics as good as those of the films obtained in Examples 1 to 4 is not obtainable by the co-plating of Cd and Se onto a glass plate with or without aluminum electrode as the substrate plate.

What is claimed is:

1. A multi-layered photoconductive material which comprises first layers comprising at least one Group VIa chalcogen element selected from the group consisting of S, Se and Te, and second layers comprising at least one Group IIb element selected from the group consisting of Zn, Cd and Hg and acting as electric potential barriers, said first layers and said second layers being alternately arranged and the total number of said first layers and said second layers being not less than 5.

2. The photoconductive material according to claim 1, wherein at least one of the first and second layers is divided into plural layers.

3. The photoconductive material according to claim 1 or 2, wherein one of the first and one of the second layers form a layer unit which has a thickness of 2 to 1,000 Å.

4. The photoconductive material according to claim 1, 2 or 3, wherein layers having approximately the same fermi level are arranged at predetermined intervals.

5. The photoconductive material according to claim 1, wherein the second layers contain Zn and/or Cd as the IIb elements.

6. The photoconductive material according to claim 1, wherein the first layers contain Se and/or Te as the VIa chalcogen elements.

7. The photoconductive material according to claim 1, wherein the amount of Group VIa chalcogen element in the first layer is at least 50 atomic %, and the amount of IIb element in the second layer is about 0.1 to 90% by weight.

* * * * *